US010482844B2

(12) United States Patent
Lin et al.

(10) Patent No.: US 10,482,844 B2
(45) Date of Patent: Nov. 19, 2019

(54) METHOD TO IMPROVE DISPLAY PERFORMANCE AT EDGES OF CIRCULAR DISPLAY SCREEN

(71) Applicant: Shanghai Tianma AM-OLED Co., Ltd., Shanghai (CN)

(72) Inventors: Fangyun Lin, Shanghai (CN); Hongling Wang, Shanghai (CN); Zhiyong Xiong, Shanghai (CN); Bojia Lv, Shanghai (CN); Bozhang Sun, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 80 days.

(21) Appl. No.: 15/709,906

(22) Filed: Sep. 20, 2017

(65) Prior Publication Data

US 2018/0012566 A1 Jan. 11, 2018

(30) Foreign Application Priority Data

Jun. 30, 2017 (CN) ..... 2017 1 0524220

(51) Int. Cl.
*G09G 5/10* (2006.01)

(52) U.S. Cl.
CPC ..... *G09G 5/10* (2013.01); *G09G 2300/0421* (2013.01)

(58) Field of Classification Search
None
See application file for complete search history.

(56) References Cited

U.S. PATENT DOCUMENTS 10,388,680 B2 * 8/2019 Zheng ..... H01L 27/14603
2010/0156945 A1 * 6/2010 Yoshida ..... G02F 1/1345 345/690
2012/0092396 A1 * 4/2012 Chui ..... G09G 3/005 345/691
2015/0294438 A1 * 10/2015 Kang ..... G06T 3/0018 345/589

(Continued)

FOREIGN PATENT DOCUMENTS

CN 1967635 A 5/2007
CN 101673491 A 3/2010

(Continued)

*Primary Examiner* — Amr A Awad
*Assistant Examiner* — Andre L Matthews
(74) *Attorney, Agent, or Firm* — Anova Law Group, PLLC

(57) ABSTRACT

A method to improve display performance at edges of a circular display screen is provided. The method comprises determining an edge area and a central area of the circular display screen, the edge area surrounding the central area; along a direction from a geometric center of the circular display screen to the edge area of the circular display screen, dividing the edge area into n display regions each having a different luminance-level, where n is a positive integer larger than 1; and according to luminance of pixels in the central area and the luminance-level of each of the n display regions, adjusting the luminance of the pixels in each of the n display regions to corresponding target luminance. Along the direction from the geometric center to the edge area of the circular display screen, the corresponding target luminance of the pixels in the n display regions sequentially decreases.

18 Claims, 4 Drawing Sheets

(56) References Cited

U.S. PATENT DOCUMENTS

| | | | | |
|---|---|---|---|---|
| 2016/0027354 | A1* | 1/2016 | Terai | G09G 3/36 345/87 |
| 2016/0125642 | A1 | 5/2016 | Zhu et al. | |
| 2018/0190946 | A1* | 7/2018 | Li | H01L 51/56 |
| 2018/0357979 | A1* | 12/2018 | Nakamura | G09G 5/10 |
| 2019/0088188 | A1* | 3/2019 | Zheng | G09G 3/2074 |

FOREIGN PATENT DOCUMENTS

| | | | |
|---|---|---|---|
| CN | 104464557 | A | 3/2015 |
| CN | 104732908 | A | 6/2015 |
| CN | 105206213 | A | 12/2015 |
| CN | 106527580 | A | 3/2017 |
| CN | 106530994 | A | 3/2017 |
| CN | 107526201 | A | 12/2017 |
| JP | 2004030135 | A | 1/2004 |

* cited by examiner

METHOD TO IMPROVE DISPLAY PERFORMANCE AT EDGES OF CIRCULAR DISPLAY SCREEN

CROSS-REFERENCES TO RELATED APPLICATION

This application claims the priority of Chinese Patent Application No. CN201710524220.8, filed on Jun. 30, 2017, the content of which is incorporated by reference in its entirety.

TECHNICAL FIELD

The present disclosure generally relates to the field of display technology and, more particularly, relates to a method to improve display performance at edges of a circular display screen.

BACKGROUND

As display screens are widely used in a large variety of electronic devices for various application scenarios, the shape of the display screen is no longer limited to a rectangle. Irregular-shaped display screens, especially circular display screens, are emerging as a hot research topic.

An existing circular display screen includes a plurality of pixels arranged in rows, in which to fit arc edges of the circular display screen, adjacent pixels are configured to have step transitions at the edges of the display screen. Because the pixel often has a rectangular shape, such step transitions induce sawtooth at the edges of the circular display screen. Moreover, because the relative arrangement of red, green and blue pixels is often fixed, the circular display screen may exhibit severe colorful edge area. On the other hand, because of Mach band effect, viewers may observe a higher luminance at the edges of the circular display screen, i.e., bright edges of the circular display screen may be observed.

The disclosed methods to improve display performance on the edges of a circular display screen are directed to solve one or more problems set forth above and other problems.

SUMMARY

One aspect of the present disclosure provides a method to improve display performance at edges of a circular display screen. The method comprises determining an edge area and a central area of the circular display screen, the edge area surrounding the central area; along a direction from a geometric center of the circular display screen to the edge area of the circular display screen, dividing the edge area into n display regions each having a different luminance-level, where n is a positive integer larger than 1; and according to luminance of pixels in the central area and the luminance-level of each of the n display regions, adjusting the luminance of the pixels in each of the n display regions to corresponding target luminance. The pixels in each of the n display regions have different corresponding target luminance, the pixels in the same display region have same corresponding target luminance, and along the direction from the geometric center to the edge area of the circular display screen, the corresponding target luminance of the pixels in the n display regions sequentially decreases.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
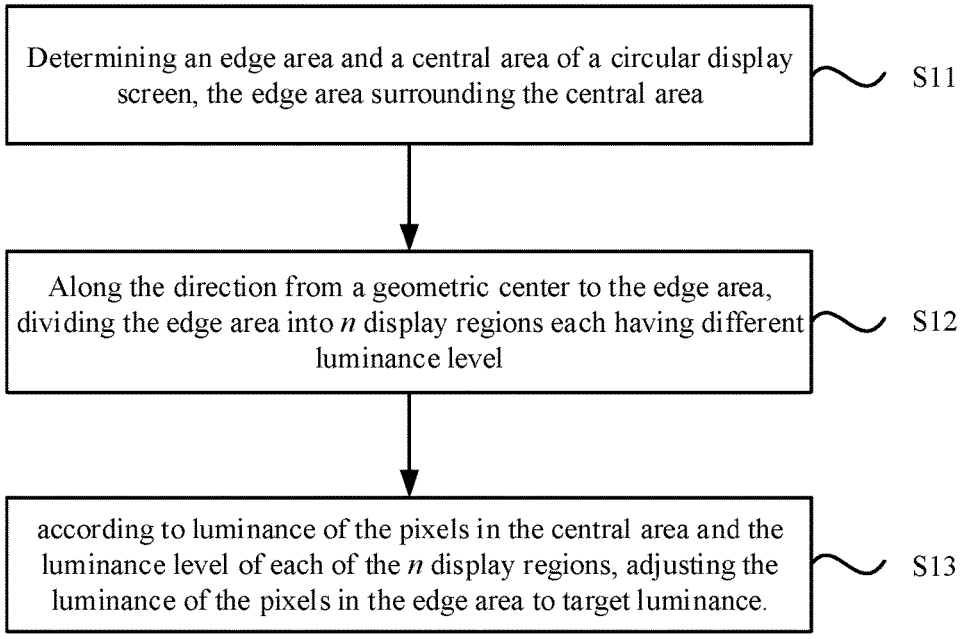
FIG. 1 illustrates a flow chart of an exemplary method to improve display performance at edges of a circular display screen consistent with disclosed embodiments.

Reference will now be made in detail to exemplary embodiments of the disclosure, which are illustrated in the accompanying drawings. Hereinafter, embodiments consistent with the disclosure will be described with reference to drawings. In the drawings, the shape and size may be exaggerated, distorted, or simplified for clarity. Wherever possible, the same reference numbers will be used throughout the drawings to refer to the same or like parts, and a detailed description thereof may be omitted.

Further, in the present disclosure, the disclosed embodiments and the features of the disclosed embodiments may be combined under conditions without conflicts. It is apparent that the described embodiments are some but not all of the embodiments of the present disclosure. Based on the disclosed embodiments, persons of ordinary skill in the art may derive other embodiments consistent with the present disclosure, all of which are within the scope of the present disclosure.

Moreover, the present disclosure is described with reference to schematic diagrams. For convenience of descriptions of the embodiments, the cross-sectional views illustrating the device structures may not follow the common proportion and may be partially exaggerated. Besides, those schematic diagrams are merely examples, and not intended to limit the scope of the invention. Furthermore, a three-dimensional (3D) size including length, width and depth should be considered during practical fabrication.

The present disclosure embodiment provides a method to improve display performance at edges of a circular display screen, which is able to suppress the sawtooth edges, colorful edges and bright edges of the circular display screen.

The method comprises determining an edge area and a central area of the circular display screen, the edge area surrounding the central area; along a direction from a geometric center of the circular display screen to the edge area of the circular display screen, dividing the edge area into n display regions each having a different luminance-level, where n is a positive integer larger than 1; and according to luminance of pixels in the central area and the luminance-level of each of the n display regions, adjusting the luminance of the pixels in each of the n display regions to corresponding target luminance. The pixels in each of the n display regions have different corresponding target luminance, the pixels in the same display region have same corresponding target luminance, and along the direction from the geometric center to the edge area of the circular display screen, the corresponding target luminance of the pixels in the n display regions sequentially decreases.

In the disclosed embodiments, the edge area and the central area of the circular display screen may be determined; along the direction from the geometric center to the edge area of the circular display screen, the edge area of the circular display screen may be divided into n display regions each having a different luminance level, where n is a positive integer larger than 1; and according to the luminance of the pixels in the central area and the luminance-level of the n display regions, the luminance of the pixels in the edge area may be adjusted to corresponding target luminance. In particular, the pixels in each of the n display regions may have different corresponding target luminance, the pixels in the same display region may have same corresponding target luminance. Along the direction from the geometric center to the edge area of the circular display screen, the corresponding target luminance of the pixels in the n display regions may sequentially decrease.

Thus, in the circular display screen, the luminance of the pixels in the edge area may be configured to be lower than the luminance of the pixels in the central area and, meanwhile, along the direction from the geometric center to the edge area of the circular display screen, the luminance of the pixels in the n display regions may be configured to decrease gradually. Thus, the sawtooth edges, colorful edges and bright edges in the circular display screen may be significantly suppressed.

FIG. 1 illustrates a flow chart of an exemplary method to improve display performance at edges of a circular display screen consistent with disclosed embodiments. As shown in FIG. 1, the method may be applied to a circular display screen which has sawtooth edges, colorful edges, and bright edges.

As shown in FIG. 1, the method may include the following steps:

Step S11: determining an edge area and a central area of the circular display screen, wherein the center of the central area is a geometric center of the circular display screen, and the edge area surrounds the central area;

Step S12: along a direction from the geometric center of the circular display screen to the edge area of the circular display screen, dividing the edge area into n display regions each having a different luminance level, where n is a positive integer larger than 1, and the n display regions are also named as n luminance-level display regions including a first luminance-level display region, a second luminance-level display region, . . . , and an n-th luminance-level display region;

Step S13: according to luminance of the pixels in the central area and the luminance levels of the n display regions, adjusting the luminance of the pixels in the edge area to corresponding target luminance, wherein the pixels in each of the n display regions have a different corresponding target luminance, the pixels in the same display region have a same corresponding target luminance, and the corresponding target luminance of the pixels in the n display regions sequentially decreases along the direction from the geometric center to the edge area of the circular display screen.

In the disclosed embodiments, the edge area and the central area of the circular display screen may be determined, and along the direction from the geometric center to the edge area of the circular display screen, the edge area of the circular display screen may be divided into n display regions each having a different luminance level, where n is a positive integer larger than 1. Then according to the luminance of the pixels in the central area and the luminance-level of the n display regions, the luminance of the pixels in the edge area may be adjusted to the corresponding target luminance. In particular, each of the n display regions may have a different corresponding target luminance, and the corresponding target luminance of the n display regions may sequentially decrease along the direction from the geometric center to the edge area of the circular display screen.

Thus, in the circular display screen, the luminance of the pixels in the edge area may be configured to be lower than the luminance of the pixels in the central area and, meanwhile, along the direction from the geometric center to the edge area of the circular display screen, the luminance of the pixels in the n display regions may be configured to decrease gradually. Thus, the sawtooth edges, colorful edges and bright edges in the circular display screen may be significantly suppressed.

Figure 2:
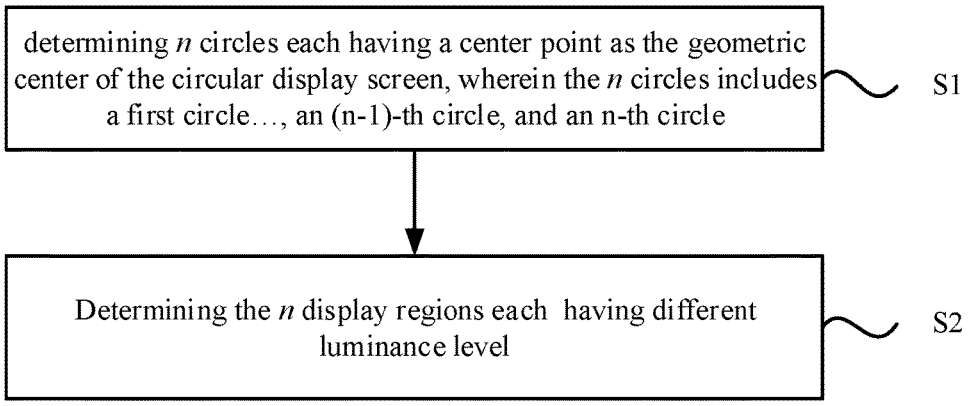
FIG. 2 illustrates a flow chart of an exemplary method to divide an edge area of a circular display screen to n display regions each having a different luminance-level consistent with disclosed embodiments.

FIG. 2 illustrates a flow chart of an exemplary method to divide an edge area of a circular display screen to n display regions each having a different luminance-level consistent with disclosed embodiments. As shown in FIG. 2, the method may include following steps.

Step S1: determining n circles (i.e., a first circle . . . , an (n−1)-th circle, and an n-th circle) each having a center point as the geometric center of the circular display screen.

In particular, determining n circles each having a center point as the geometric center of the circular display screen (i.e., Step S1) may further include:

determining at least one first pixel with a furthest distance from a center of the first pixel to the geometric center of the circular display screen;

determining the n-th circle which has the center as the geometric center of the circular display screen and crosses the at least one first pixel; and based on the radius of the determined n-th circle, determining the (n−1)-th circle to the first circle in accordance with a rule that the radius of the (n−1)-th circle to the first circle is gradually decreased by a preset luminance-decreasing radius k.

Step S2: determining the n display regions each having different luminance level.

In particular, determining the n display regions each having a different luminance level (i.e., Step S2) may further include:

determining a first pixel group including a plurality of pixels in which the center of each pixel is crossed by the i-th circle;

determining a second pixel group which is disposed between the i-th circle and the (i−1)-th circle and includes at least one pixel (for example, named as an A pixel for easy description), in which in a direction from the center of the A pixel to the geometric center of the circular display screen, the distance from the center of the A pixel to the circumference of the (i−1)-th circle is smaller than the distance from the center of the A pixel to the circumference of the i-th circle; and determining a third pixel group which is disposed between the i-th circle and the (i+1)-th circle and includes at least one pixel (for example, named as a B pixel for easy description), in which in a direction from the center of the B pixel to the geometric center of the circular display screen, the distance from the center of the B pixel to the circumference of the i-th circle is smaller than the distance from the center of the B pixel to the circumference of the (i+1)-th circle.

In particular, when i=n, a region including all pixels in the first and second pixel group may be determined as the display region with the n-th luminance level, i.e., the n-th luminance-level display region. When i∈[2, n−1], a region including all pixels in the first, second and the third pixel group may be determined as the display region with the i-th luminance level, i.e., the i-th luminance-level display region. When i=1, a region including all pixels in the first and the third pixel group may be determined as the display region with the first luminance level, i.e., the first luminance-level display region.

Reference will now be made in detail to exemplify the method to divide the edge area of the circular display screen to n display regions each having a different luminance-level in which n=3.

Figure 3:
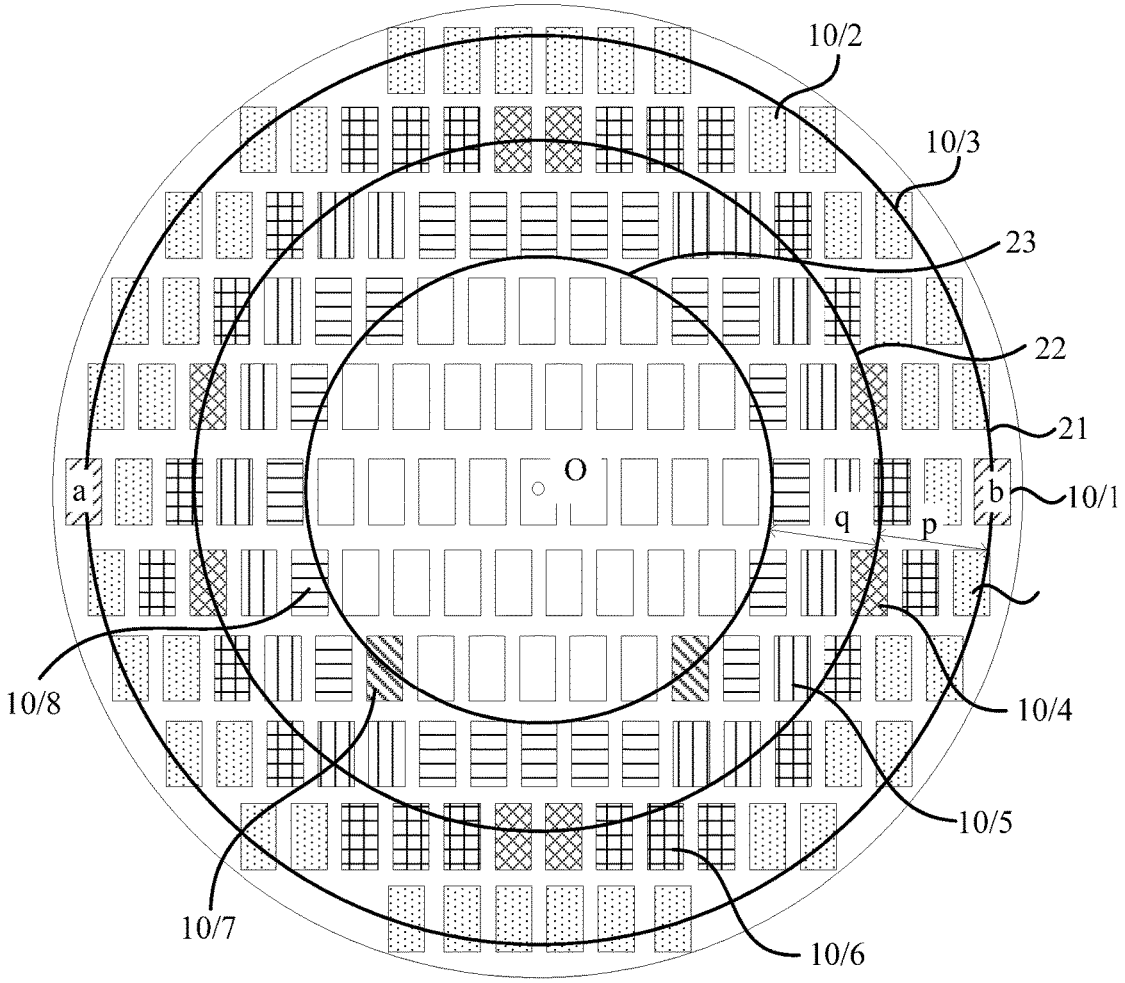
FIG. 3 illustrates a schematic top view of an exemplary circular display screen consistent with disclosed embodiments.

FIG. 3 illustrates a schematic top view of an exemplary circular display screen consistent with disclosed embodiments. As shown in FIG. 3, the circular display screen may include a plurality of rectangular pixels 10 arranged in row.

First, the third circle may be determined. That is, at least one first pixel with a furthest distance from a center of the first pixel to the geometric center of the circular display screen may be determined. Thus, the third circle having the center as the geometric center of the circular display screen and crossing the center of the at least one first pixel may be determined. As shown in FIG. 3, the pixel a and b may be determined as the first pixels 10/1 each having a furthest distance from the center of the pixel a/b to the geometric center of the circular display screen. Then the circle 21 which has the center as the geometric center of the circular display screen and crosses the center of the two first pixels 10/1 may be determined the third circle.

Secondly, the second and first circle may be determined. In particular, based on the radius of the third circle, the radius of the second and first circle may be determined by sequentially decreasing the radius of the third circle by the preset luminance-decreasing radius k. As shown in FIG. 3, the circle 21, 22 and 23 may be determined as the third, second and first circle, respectively. In the direction from the geometric center of the circular display screen to the edge area of the circular display screen, the distance p between the third circle 21 and the second circle 22, and the distance q between the second circle 22 and first circle 23 each may be the preset luminance-decreasing radius k.

In one embodiment, the preset luminance-decreasing radius k may be configured to be approximately 0.1 to 0.4 of the pixel size. When the pixel 10 has a rectangular shape, the pixel size may be either the length or the width of the pixel 10.

Thirdly, the display region with the third luminance level, the second luminance level, and the first luminance-level (i.e., the first luminance-level display region, the second luminance-level display region, and the third luminance-level display region) may be determined respectively.

As shown in FIG. 3, for the display region with the third luminance level, the first pixel group may be formed by a plurality of first pixels 10/1 in which the center of each first pixel 10/1 is crossed by the third circle 21. The second pixel group may be formed by a plurality of second pixels 10/2 disposed between the third circle 21 and second circle 22, in which in the direction from the center of the second pixel 10/2 to the geometric center of the circular display screen, the distance from the center of each second pixels 10/2 to the circumference of the third circle 21 may be smaller than the distance from the center of each second pixel 10/2 to the circumference of the second circle 22. The area including all pixels in the first and second pixel group may be determined as the display region with the third luminance level, i.e., the third luminance-level display region.

For the display region with the second luminance level, the first pixel group may be formed by a plurality of fourth pixels 10/4 in which the center of each fourth pixel 10/4 may be crossed by the second circle 22. The second pixel group may be formed by a plurality of fifth pixels 10/5 disposed between the second circle 22 and first circle 23, in which in the direction from the center of the fifth pixel 10/5 to the geometric center of the circular display screen, the distance from the center of each fifth pixel 10/5 to the circumference of the second circle is smaller than the distance from the center of each fifth pixel 10/5 to the circumference of the first circle 23. The third pixel group may be formed by a plurality of sixth pixels 10/6 disposed between the second circle 22 and third circle 21,in which in the direction from the center of the sixth pixel 10/6 to the geometric center of the circular display screen, the distance from the center of each sixth pixel 10/6 to the circumference of the second circle 22 is smaller than the distance from the center of each sixth pixel 10/6 to the circumference of the third circle 21. Then the area including all the pixels in the first, second and the third pixel group may be determined as the display region with the second luminance level, i.e., the second luminance-level display region.

For the display region with the first luminance level, the first pixel group may be formed by a plurality of seventh pixels 10/7 in which the center of each seventh pixel 10/7 may be crossed by the first circle. The third pixel group may be formed by a plurality of eighth pixels 10/8 disposed between the first circle 23 and the second circle 22, in which in the direction from the center of the eighth pixel 10/8 to the geometric center of the circular display screen, the distance from the center of each eighth pixel 10/8 to the circumference of the first circle 23 is smaller than the distance from the center of each eighth pixel 10/8 to the circumference of the second circle 22. Then the area including all the pixels in the first and third pixel group may be determined as the display region with the first luminance level, i.e., the first luminance-level display region.

It should be noted that, when the distances from the center of a pixel to the adjacent two circles are equal, the pixel may belong to either display regions corresponding to either of the two adjacent circles.

Figure 4:
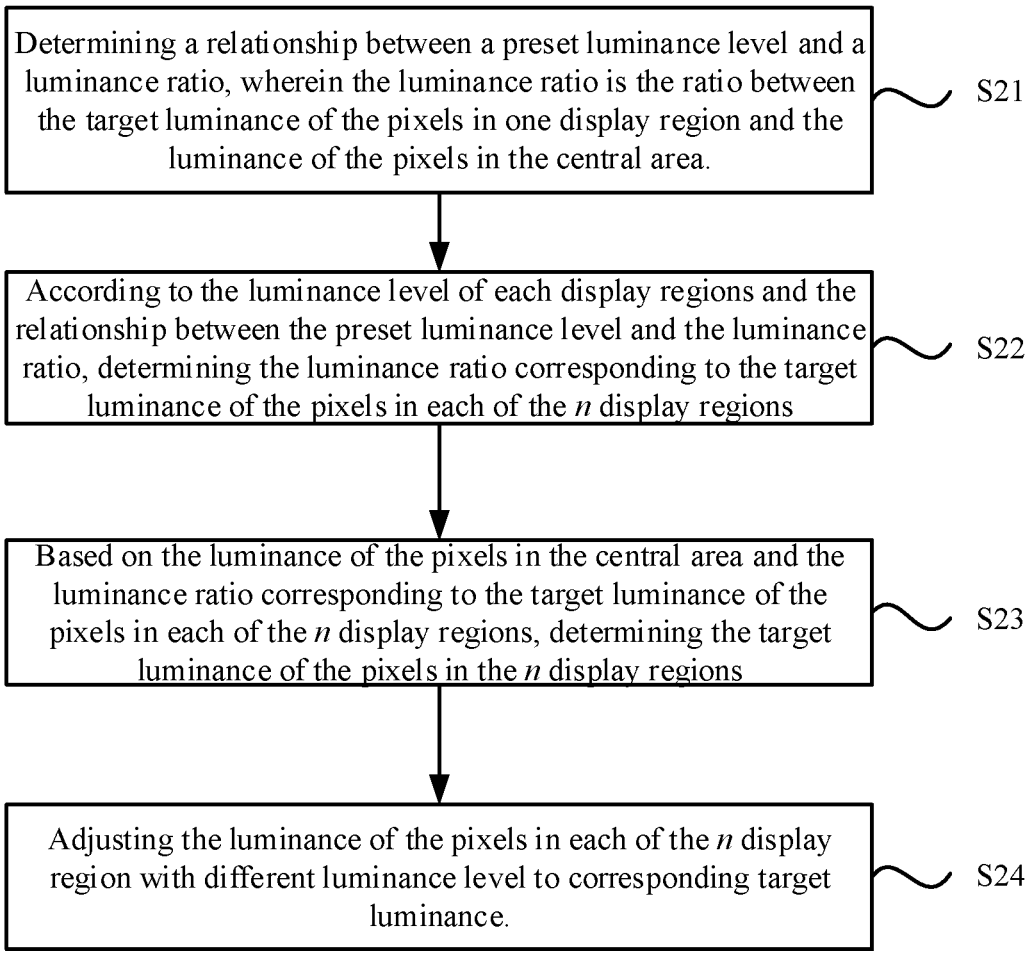
FIG. 4 illustrates a flow chart of an exemplary method to adjust luminance of pixels in an edge area to corresponding target luminance consistent with disclosed embodiments.

FIG. 4 illustrates a flow chart of an exemplary method to adjust luminance of pixels in an edge area to corresponding target luminance consistent with disclosed embodiments. As shown in FIG. 4, the method to adjust luminance of pixels in an edge area to corresponding target luminance may include the following steps.

Step S21: determining a relationship between a preset luminance-level and a luminance ratio, wherein the luminance ratio is the ratio between the target luminance of the pixels in one display region and the luminance of the pixels in the central region.

It should be noted that, the relationship between the luminance-level and the luminance ratio may be determined according to various application scenarios, which is not limited by the present disclosure.

In one embodiment, along the direction from the geometric center to the edge area of the circular display screen, the edge area of the circular display screen may be divided into a first luminance-level display region, a second luminance-level display region and a third luminance-level display region. For the first luminance-level display region, the luminance-level may be configured as 1, and the luminance ratio may be configured as 1/2. For the second luminance-level display region, the luminance-level may be configured as 2, and the luminance ratio may be configured as 1/2. For the third luminance-level display region, the luminance-level may be configured as 3, and the luminance ratio may be configured as 1/4.

The target luminance may refer to the final display luminance of the pixel. In one embodiment, the target luminance may be the adjusted luminance of the pixels in the circular display screen where the luminance of the pixels in the edge area is to be adjusted. In another embodiment, the target luminance may be the luminance determined in advance for the pixels in the circular display screen which is firstly turned on.

In one embodiment, along the direction from the geometric center to the edge area of the circular display screen, the ratios between the target luminance of the pixels in n display region and the luminance of the pixels in the center region may form an arithmetic sequence. In one embodiment, the common difference of the arithmetic sequence may be configured as approximately 0.1.

For example, along the direction from the geometric center to the edge area of the circular display screen, the edge area of the circular display screen may be divided into a first luminance-level display region, a second luminance-level display region, and a third luminance-level display region. The ratio between the target luminance of the pixels in the first luminance-level display region and the luminance of the pixels in the central region may be configured as approximately 0.9. The ratio between target luminance of the pixels in the second luminance-level display region and the luminance of the pixels in the central region may be configured as approximately 0.8. The ratio between target luminance of the pixels in the third luminance-level display region and the luminance of the pixels in the central region may be configured as approximately 0.7. That is, along the direction from the geometric center to the edge area of the circular display screen, the luminance of the pixels in each display region with a different luminance-level may be decreasing more smoothly, thereby improving the visual experience of the users.

In another embodiment, along the direction from the geometric center to the edge area of the circular display screen, the ratios between the target luminance of the pixels in n display regions and the luminance of the pixels in the center region may form a geometric sequence. In one embodiment, the common ratio of the geometric sequence may be configured as approximately 1/2.

For example, along the direction from the geometric center to the edge area of the circular display screen, the edge area of the circular display screen may be divided into a first luminance-level display region, a second luminance-level display region, and a third luminance-level display region. The ratio between target luminance of the pixels in the first luminance-level display region and the luminance of the pixels in the central region may be configured as approximately 0.5, the ratio between target luminance of the pixels in the second luminance-level display region and the luminance of the pixels in the central region may be configured as approximately 0.25, the ratio between target luminance of the pixels in the third luminance-level display region and the luminance of the pixels in the central region may be configured as approximately 0.125.

That is, along the direction from the geometric center to the edge area of the circular display screen, the luminance of the pixels in each display region with a different luminance-level may be decreasing by a certain multiple relationship. Thus, when the number of the display regions with different luminance-levels is substantially small, while the difference of the luminance of the pixels in adjacent display regions is substantially large, the ratio between target luminance of the pixels in each display region and the luminance of the pixels in the central region may be determined through a simple geometric sequence.

Step S22: according to the luminance-level of each display regions and the relationship between the preset luminance and the luminance ratio, determining the luminance ratio corresponding to the target luminance of the pixels in the n display regions each having a different luminance-level.

In one embodiment, n may be larger than 3. A small number of the display regions may induce obvious difference between the luminance of the edge area and the central area, and degrade the visual experience of users.

In another embodiment, n may be 15. Along the direction from the geometric center to the edge area of the circular display screen, the ratios between the target luminance of the pixels in the n display regions and the luminance of the pixels in the central area may be sequentially configured as approximately 0.9, 0.8, 0.6, 0.5, 0.4, 0.3, 0.2, 0.1, 0.08, 0.06, 0.04, 0.03, 0.02, and 0.01.

Step S23: based on the luminance of the pixels in the central area and the luminance ratio corresponding to the target luminance of the pixels in the n display regions, determining the target luminance of the pixels in the n display regions.

In one embodiment, the luminance of the pixels in the central area may be the average value of the luminance of all pixels in the central area, such that the pixels in the central area may have a stable luminance when display images. In another embodiment, the luminance of the pixels in the central area may be the luminance of any pixel which is closest to the geometric center of the display screen, such that the luminance of the pixels in the central area may be rapidly determined without a calculation.

The target luminance of the pixels in each display region with a specific luminance-level is the product between the ratio between the target luminance of the pixels in this display region to the luminance of the pixels in the central area and the luminance of the pixels in the central region.

Step S24: adjusting the luminance of the pixels in the n display region each having a different luminance-level to the corresponding target luminance.

In the disclosed embodiments, the edge area and the central area of the circular display screen may be determined; along the direction from the geometric center to the edge area of the circular display screen, the edge area of the circular display screen may be divided into n display regions each having a different luminance level, where n is a positive integer larger than 1; and according to the luminance of the pixels in the central area and the luminance-level of the n display regions, the luminance of the pixels in the edge area may be adjusted to corresponding target luminance.

In particular, the pixels in each of the n display regions may have different corresponding target luminance, the pixels in the same display region may have same corresponding target luminance. Along the direction from the geometric center to the edge area of the circular display screen, the corresponding target luminance of the pixels in the n display regions may sequentially decrease.

Thus, in the circular display screen, the luminance of the pixels in the edge area may be configured to be lower than the luminance of the pixels in the central area and, meanwhile, along the direction from the geometric center to the edge area of the circular display screen, the luminance of the pixels in the n display regions may be configured to decrease gradually. Thus, the sawtooth edges, colorful edges and bright edges in the circular display screen may be significantly suppressed.

Various embodiments have been described to illustrate the operation principles and exemplary implementations. It should be understood by those skilled in the art that the present invention is not limited to the specific embodiments described herein and that various other obvious changes, rearrangements, and substitutions will occur to those skilled in the art without departing from the scope of the invention. Thus, while the present invention has been described in detail with reference to the above described embodiments, the present invention is not limited to the above described embodiments, but may be embodied in other equivalent forms without departing from the scope of the present invention, which is determined by the appended claims.

What is claimed is:

1. A method for improving display performance at edges of a circular display screen, comprising:

determining an edge area and a central area of the circular display screen, the edge area surrouding the central area;

along a direction from a geometric center of the circular display screen to the edge area of the circular display screen, dividing the edge area into n display regions each having a different luminance-level, where n is a positive integer larger than 1; and according to luminance of pixels in the central area and the luminance-level of each of the n display regions, adjusting luminance of pixels in each of the n display regions to corresponding target luminance, wherein:

the pixels in each of the n display regions have different corresponding target luminance, the pixels in a same display region have same corresponding target luminance, and along the direction from the geometric center to the edge area of the circular display screen, the corresponding target luminance of each of the pixels in different display regions sequentially decreases and ratios between the corresponding target luminance of the pixels in the n display regions and the luminance of the pixels in the central area form an arithmetic sequence, and the arithmetic sequence has a common ratio of approximately ½.

2. The method according to claim 1, wherein along the direction from the geometric center of the circular display screen to the edge area of the circular display screen, dividing the edge area into the n display regions each having the different luminance-level further includes:

determining n circles each having a center point as the geometric center of the circular display screen, wherein the n circles includes a first circle . . . , an (n−1)-th circle, and an n-th circle; and determining the n display regions each having the different luminance-level.

3. The method according to claim 2, wherein determining the n circles each having the center point as the geometric center of the circular display screen further includes:

determining at least one first pixel which has a furthest distance from a center of the at least one first pixel to the geometric center of the circular display screen;

determining the n-th circle which has the center point as the geometric center of the circular display screen and crosses the at least one first pixel; and based on a radius of the determined n-th circle, determining the (n−1)-th circle to the first circle in accordance with a rule that a radius of the (n−1)-th circle to the first circle is sequentially decreased by a preset luminance-decreasing radius k.

4. The method according to claim 3, wherein:

the preset luminance-decreasing radius k is configured to be approximately 0.1 to 0.4 of a pixel size.

5. The method according to claim 2, wherein determining the n display regions each having the different luminance-level further includes:

determining a first pixel group including a plurality of pixels in which a center of each pixel is crossed by an i-th circle, where i is a positive integer, $1 \le i \le n$;

determining a second pixel group disposed between the i-th circle and a (i−1)-th circle and formed by at least one A pixel, in which in a direction from a center of the at least one A pixel to the geometric center of the circular display screen, a distance from the center of the at least one A pixel to a circumference of the (i−1)-th circle is smaller than a distance from the center of the at least one A pixel to a circumference of the i-th circle; and determining a third pixel group disposed between the i-th circle and a (i+1)-th circle and formed by at least one B pixel, in which in a direction from a center of the at least one B pixel to the geometric center of the circular display screen, a distance from the center of the at least one B pixel to the circumference of the i-th circle is smaller than a distance from the center of the at least one B pixel to a circumference of the (i+1)-th circle.

6. The method according to claim 5, wherein determining the n display regions each having the different luminance-level further includes:

when i=n, determining a region including all pixels in the first and second pixel groups to be a display region with an n-th luminance-level;

when $i \in [2, n-1]$, determining a region including all pixels in the first, second and third pixel groups to be a display region with an i-th luminance-level; and when i=1, determining a region including all pixels in the first and third pixel groups to be a display region with a first luminance level.

7. The method according to claim 1, wherein according to the luminance of pixels in the central area and the luminance-level of each of the n display regions, adjusting the luminance of the pixels in each of the n display regions to the corresponding target luminance further includes:

determining a relationship between a preset luminance-level and a luminance ratio for each of the n display regions, wherein the luminance ratio is a ratio between the corresponding target luminance of the pixels in each of the n display regions and the luminance of the pixels in the central area;

according to the luminance-level of each of the n display regions, as well as, the relationship between the preset luminance-level and the luminance ratio of each of the n display regions, determining the luminance ratio corresponding to the target luminance of the pixels in each of the n display regions; and based on the luminance of the pixels in the central area and the luminance ratio corresponding to the target luminance of the pixels in each of the n display regions, determining the corresponding target luminance of the pixels in each of the n display regions.

8. The method according to claim 1, wherein the luminance of the pixels in the central area is an average value of the luminance of all the pixels in the central area.

9. The method according to claim 1, wherein n is an integer equal to or larger than 3.

10. The method according to claim 9, wherein n is 15.

11. The method according to claim 1, wherein:

along the direction from the geometric center of the circular display screen to the edge area of the circular display screen, ratios between the corresponding target luminance of the pixels in the n display regions and the luminance of the pixels in the central area form a geometric sequence.

12. The method according to claim 1, wherein:

the edge area of the circular display screen is divided into a first luminance-level display region, a second luminance-level display region, and a third luminance-level display region; and along the direction from the geometric center of the circular display screen to the edge area of the circular display screen, ratios between the corresponding target luminance of pixels in the first, second and third luminance-level display regions and the luminance of the pixels in the central area are approximately 0.9, 0.8 and 0.7, respectively.

13. The method according to claim 1, wherein:

the edge area of the circular display screen is divided into a first luminance-level display region, a second luminance-level display region, and a third luminance-level display region; and along the direction from the geometric center of the circular display screen to the edge area of the circular display screen, ratios between the corresponding target luminance of pixels in the first, second and third luminance-level display regions and the luminance of the pixels in the central area are approximately 0.5, 0.25 and 0.125, respectively.

14. The method according to claim 1, wherein the luminance of the pixels in the central area is configured to be luminance of one or more pixels closest to the central area.

15. The method according to claim 4, wherein:

the pixel size is a length or a width of a pixel.

16. A method for improving display performance at edges of a circular display screen, comprising:

determining an edge area and a central area of the circular display screen, the edge area surrouding the central area;

along a direction from a geometric center of the circular display screen to the edge area of the circular display screen, dividing the edge area into n display regions each having a different luminance-level, where n is 15; and according to luminance of pixels in the central area and the luminance-level of each of the n display regions, adjusting luminance of pixels in each of the n display regions to corresponding target luminance, wherein the pixels in each of the n display regions have different corresponding target luminance, the pixels in a same display region have same corresponding target luminance, along the direction from the geometric center to the edge area of the circular display screen, the corresponding target luminance of the pixels in the n display regions sequentially decreases, and along the direction from the geometric center of the circular display screen to the edge area of the circular display screen, ratios between the corresponding target luminance of the pixels in the n display regions and the luminance of the pixels in the central area is sequentially configured to be approximately 0.9, 0.8, 0.6, 0.5, 0.4, 0.3, 0.2, 0.1, 0.08, 0.06, 0.04, 0.03, 0.02, and 0.01.

17. The method according to claim 16, wherein the luminance of the pixels in the central area is an average value of the luminance of all the pixels in the central area.

18. A method for improving display performance at edges of a circular display screen, comprising:

determining an edge area and a central area of the circular display screen, the edge area surrouding the central area;

along a direction from a geometric center of the circular display screen to the edge area of the circular display screen, dividing the edge area into n display regions each having a different luminance-level, where n is a positive integer larger than 1; and according to luminance of pixels in the central area and the luminance-level of each of the n display regions, adjusting luminance of pixels in each of the n display regions to corresponding target luminance, wherein the pixels in each of the n display regions have different corresponding target luminance, the pixels in a same display region have same corresponding target luminance, along the direction from the geometric center to the edge area of the circular display screen, the corresponding target luminance of the pixels in the n display regions sequentially decreases, along the direction from the geometric center of the circular display screen to the edge area of the circular display screen, ratios between the corresponding target luminance of the pixels in the n display regions and the luminance of the pixels in the central area form an arithmetic sequence, and the arithmetic sequence has a common difference of approximately 0.1.

* * * * *